US012102233B2

(12) United States Patent
Kamal El Din

(10) Patent No.: US 12,102,233 B2
(45) Date of Patent: Oct. 1, 2024

(54) FLEXIBLE FOLDABLE FURNITURE USING HONEYCOMB TECHNOLOGY

(71) Applicant: Elephant in a Box, Inc., New York, NY (US)

(72) Inventor: Mohamed El Sayed Ahmed Kamal El Din, New York, NY (US)

(73) Assignee: Elephant in a Box, Inc., New York, NY (US)

( * ) Notice: Subject to any disclaimer, the term of this patent is extended or adjusted under 35 U.S.C. 154(b) by 220 days.

(21) Appl. No.: 17/591,541

(22) Filed: Feb. 2, 2022

(65) Prior Publication Data

US 2022/0151392 A1 May 19, 2022

Related U.S. Application Data

(63) Continuation-in-part of application No. 17/049,659, filed as application No. PCT/EG2019/000010 on Apr. 17, 2019, now Pat. No. 11,246,424.
(Continued)

(51) Int. Cl.
*A47C 19/04* (2006.01)
*A47C 17/76* (2006.01)
(Continued)

(52) U.S. Cl.
CPC ..... *A47C 19/04* (2013.01); *A47C 17/76* (2013.01); *A47C 17/86* (2013.01); *A47C 19/021* (2013.01); *A47C 31/001* (2013.01)

(58) Field of Classification Search
CPC ..... A47C 19/00; A47C 19/04; A47C 17/76; A47C 17/86; A47C 19/021; A47C 31/001; A47C 5/005
See application file for complete search history.

(56) References Cited

U.S. PATENT DOCUMENTS 2,587,302 A 2/1952 Fawcett
3,866,550 A 2/1975 Geschwender
(Continued)

FOREIGN PATENT DOCUMENTS

CN 2250136 Y 3/1997
CN 201115537 Y 9/2008
(Continued)

OTHER PUBLICATIONS

Extended Search Report , European Patent Office, Application No. 23154685.4, dated Jul. 3, 2023.
(Continued)

*Primary Examiner* — Fredrick C Conley
(74) *Attorney, Agent, or Firm* — C. Tumey Law Group PLLC

(57) ABSTRACT

An improved furniture system, including methods of manufacture, is disclosed. The furniture may be a sofa or a bed, which is reduced to a minimum volume for transportation. A flexible foldable honeycomb structure is used in manufacturing a supporting structure, wherein the hexagonal shape of said structure is strong and stable and provides a high bearing capacity versus weight. The honeycomb structure is designed to be foldable and used for saving space and to be easier for delivery in a box that fits in a small car, wherein said structure used flaccid materials that are glued to each other in certain ways to open and close easily, and wherein the number of layers of the flaccid materials determines the expansion length of the structure.

20 Claims, 16 Drawing Sheets

Related U.S. Application Data

(60) Provisional application No. 62/661,484, filed on Apr. 23, 2018.

(51) Int. Cl.

| | |
|---|---|
| ***A47C 17/86*** | (2006.01) |
| ***A47C 19/02*** | (2006.01) |
| *A47C 31/00* | (2006.01) |

(56) References Cited

U.S. PATENT DOCUMENTS

| | | | | |
|---|---|---|---|---|
| 4,824,411 | A | 4/1989 | McClanahan | |
| 4,881,779 | A | 11/1989 | Bubien | |
| 6,253,530 | B1 | 7/2001 | Price et al. | |
| 6,372,322 | B1 | 4/2002 | Devaguptapu | |
| 6,401,282 | B1 | 6/2002 | Shum | |
| 6,800,351 | B1 | 10/2004 | Pflug et al. | |
| 11,246,424 | B2 | 2/2022 | Kamal El Din | |
| 2005/0278860 | A1 | 12/2005 | Landi et al. | |
| 2008/0157582 | A1* | 7/2008 | Bertele | A47B 43/02 248/346.4 |
| 2008/0237319 | A1 | 10/2008 | Hensey et al. | |
| 2009/0078838 | A1 | 3/2009 | Chang | |
| 2010/0019630 | A1 | 1/2010 | Leng | |
| 2013/0187429 | A1* | 7/2013 | Guerrero | A47C 5/005 297/452.18 |
| 2016/0058203 | A1 | 3/2016 | Yaacoby | |
| 2016/0183674 | A1 | 6/2016 | Lee | |

FOREIGN PATENT DOCUMENTS

| | | | |
|---|---|---|---|
| CN | 104720421 | A | 6/2015 |
| CN | 206659510 | U | 11/2017 |
| DE | 102009005869 | | 7/2010 |
| WO | 2011/058348 | A1 | 5/2011 |
| WO | 2017/000607 | A1 | 1/2017 |
| WO | 2017/005363 | A1 | 1/2017 |
| WO | 2019/206390 | | 10/2019 |

OTHER PUBLICATIONS

ISA/US, PCT International Search Report and Written Opinion and PCT International Preliminary Report on Patentability issued in PCT International Application No. PCT/EG2019/000010 dated Apr. 1, 2020.

* cited by examiner

Cross section A-A Side View Expanded Bed

Expanded Side View Expanded Bed

Top View folded Bed

Side View folded Bed

FLEXIBLE FOLDABLE FURNITURE USING HONEYCOMB TECHNOLOGY

This application is a continuation-in-part of U.S. patent application Ser. No. 17/049,659, filed Oct. 22, 2020 and allowed, and scheduled by the USPTO to be issued on Feb. 15, 2022 as U.S. Pat. No. 11,246,424; which is a National Stage Entry of PCT/EG2019/000010, filed Apr. 17, 2019; which claims priority to U.S. Provisional Patent Application No. 62/661,484, filed Apr. 23, 2018, and all of which are incorporated by reference.

FIELD OF THE INVENTION

The present invention is related to flexible foldable furniture components and their advantages in both transportation and installation by using honeycomb technology.

BACKGROUND OF THE PRESENT INVENTION

A honeycomb structure is used to provide flexibility of a structure to open and close, which provides great reduction in volume and weight. The hexagonal shape of the structure proves to be very strong and stable, giving high bearing capacity versus weight. A honeycomb structure is a structure of flaccid materials that may be glued to each other in certain ways that makes them open and close easily. The glue lines' width and the distance between the glue lines affect the flexibility of the structure. The number of layers of the flaccid materials determines the expansion length of the structure. The glued layers can be of any number depending on the design needed. These layers together are being called a block of honeycomb. By cutting a honeycomb block into certain shapes, we can provide different shapes. The block can be cut into the shape of a seat or a bed. By providing the supporting boards, armrests, foam, fiber, and accessories, the final product can be a complete seat or a bed.

BRIEF DESCRIPTION OF THE PRESENT INVENTION

While the present invention is directed to a piece of furniture, such as but not limited to a couch, a bed, or a chair, one important aspect of the present invention is an internal foundation formed of honeycombed material. The present application details the manufacturing process and materials used for formation of a honeycomb-based furniture piece. Importantly, the dimensions discussed herein are merely exemplary and different furniture may be available in different dimensions. However, the general process described herein applies.

According to the present invention, the honeycomb structure is the main supporting structure for a piece of furniture such as but not limited to a bed, a sofa, a love seat, a chair, an ottoman, or a corner unit. It has a high bearing capacity when it is unfolded (expanded). In the current system, the weight of the honeycomb structure for the sofa is about 10 Kg using flaccid material like paper, plastic, or others. The honeycomb structure is connected to boards on both sides. These boards can be made out of wood or other materials for providing additional structure. The overall structure is then expanded and held in place using extension rods or pieces that can be made out of wood or any other comparable material. The extension of the structure can range from 6 to 1000 meter depending on the number of layers in the honeycomb. Typically, the seating portion can be extended from 40 to 400 cm. The rods linearly hold the structure in place by connectors that can be steel, plastic, or any other material. Armrests when included preferably are connected directly to the seat's honeycomb structure. The connection could be by applying glue or by providing connectors to the armrests to connect them to the seat's honeycomb structure. The weight of the armrest can be from 2 kg to 40 kg each depending on the materials used. After extending the structure, a padding can be provided to protect the structure against damage. Upon the structure, with or without the padding, sponge may be used to provide cushioning.

DETAILED DESCRIPTION OF THE PRESENT INVENTION

Figure 1:
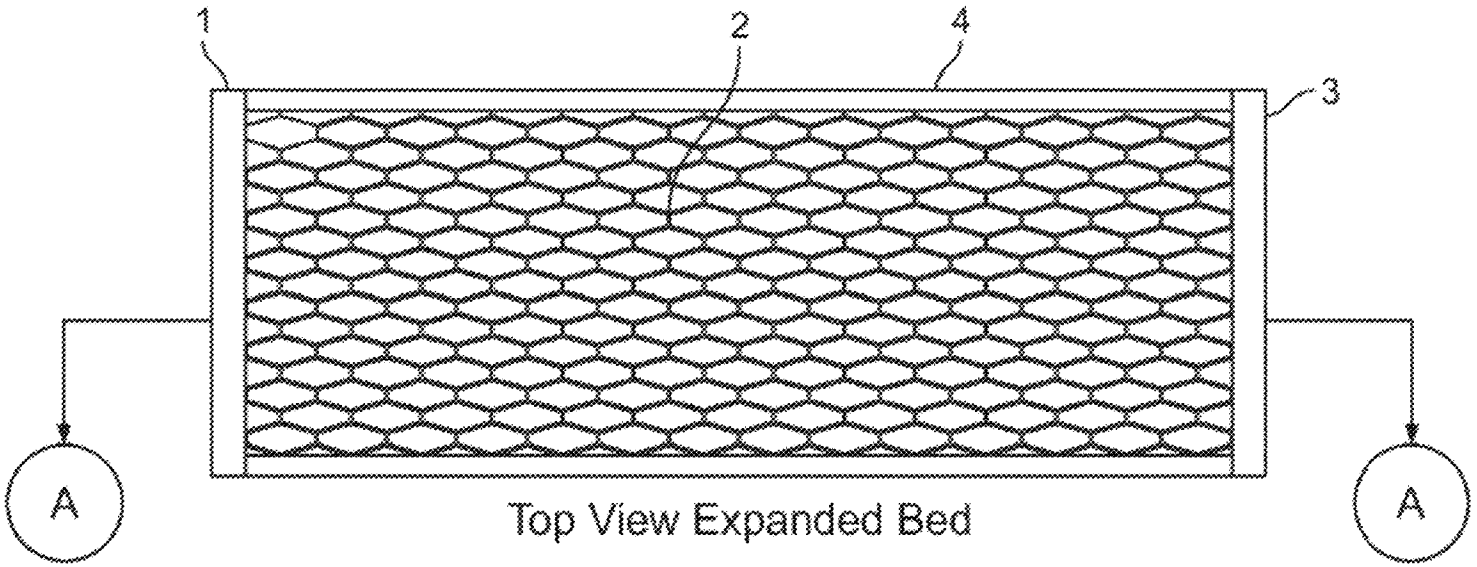
FIG. 1 shows a top view of the expanded bed, comprising Headboard (1), flexible hexagonal Structure (2), End Board (3), and Side Board (4).
Figure 2:
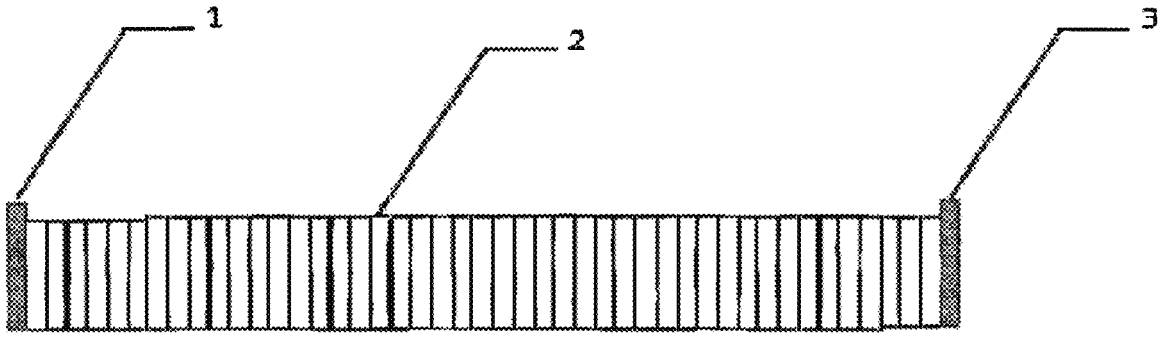
FIG. 2 shows a cross section A-A Side view of the expanded bed, wherein it shows Headboard (1), flexible hexagonal Structure (2), and End Board (3).
Figure 3:
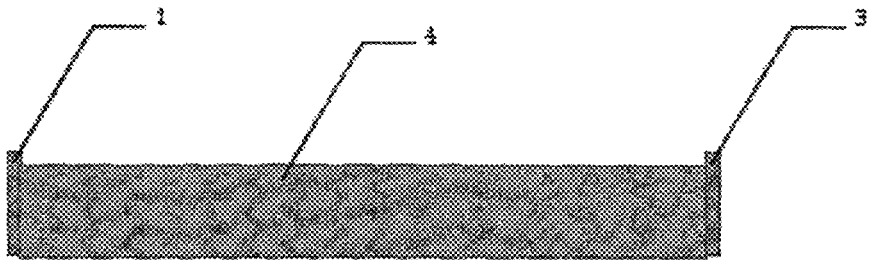
FIG. 3 shows an expanded side view of the expanded bed, wherein it shows Headboard (1), End Board (3), and Side Board (4).
Figure 4:
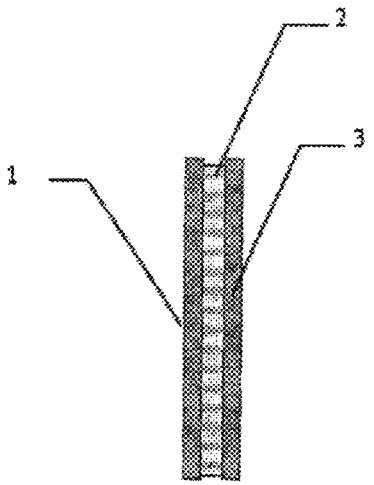
FIGS. 4 and 5 show a top and a side view respectively of the folded bed, wherein it shows Headboard (1), flexible hexagonal Structure (2), End Board (3).
Figure 5:
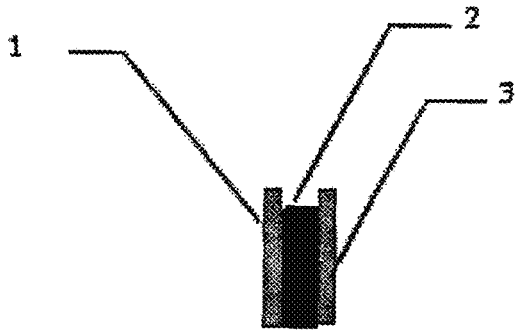
Figure 6:
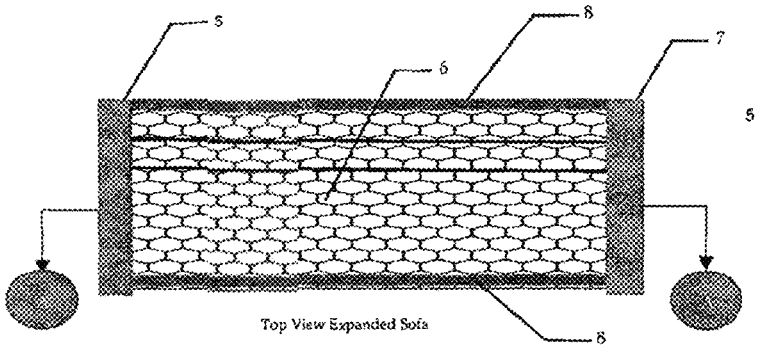
FIG. 6 shows a top view of the expanded sofa, wherein the claimed sofa comprising Flexible hexagonal Structure (5), Side board (6), Extension rods (7), Armrest (8), and Padding (9).
Figure 7:
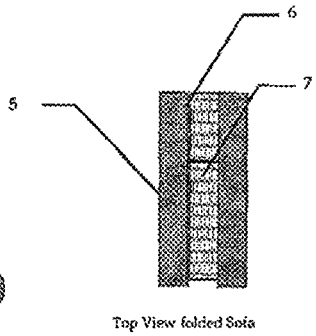
FIG. 7 shows a particular embodiment of a top view of a folded Sofa in order to clarify the flexible hexagonal Structure (5), Side board (6), and Extension rods (7).
Figure 8:
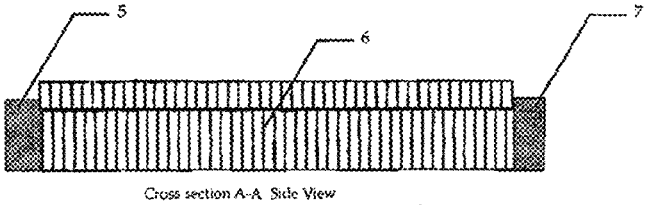
FIG. 8 shows a particular embodiment of the foldable sofa a cross section A-A Side View in order to clarify the flexible hexagonal Structure (5), Side board (6), and Extension rods (7).
Figure 9:
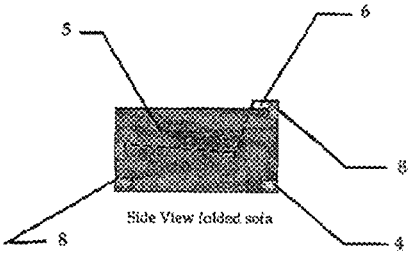
FIG. 9 shows a particular embodiment of the Side View of a folded sofa in order to clarify the flexible hexagonal Structure (5), Side board (6), and Armrest (8).
Figure 10:
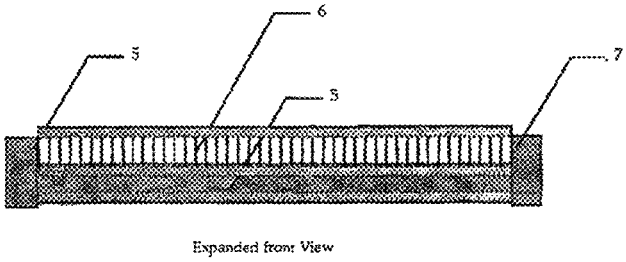
FIG. 10 shows a particular embodiment of the expanded front view of the foldable sofa to clarify the flexible hexagonal Structure (5), Side board (6), Extension rods (7), and Padding (9).

The present invention is directed to honeycomb-based furniture and methods of formation of said furniture. The honeycomb structure of the current invention can be used to make a bed frame or sofa. The utility of a portable foldable bed or seat can be measured according to the below main criteria:

The weight of the seat or bed.

The volume of the seat or bed when it is folded.

The time required to fold/unfold the seat or bed.

The bearing capacity of the seat or bed.

The time of assembly and disassembly.

In the current system of the present invention, the weight of the foldable seat is about 11 kg of honeycomb paper (The two side boards are not included.).

The volume of the seat when it is folded 60-110 cm length×40-90 cm width×Thickness 3-10 cm without the armrest.

The time required to fold/unfold the seat is 1-2 minutes.

The bearing capacity of the seat is at least 40 tons/m2.

The whole furniture piece can be provided for delivery folded in one or more carton boxes. The structure can be either a seat, love seat, or a sofa, as examples, for one to three people or more. When this seat is made to be a sofa for three people, the foldable volume of the sofa is at least 50% less than the fixed sofas/flat pack sofas in the market. The weight of the sofa is at least 50% less than the counterpart sofas on the market.

The honeycomb structure of the current invention can also be used to make a bed frame. The quality of a portable foldable bed is also measured according to the below main criteria:

The weight of the bed.

The volume of the bed when it is folded.

The time required to fold/unfold the bed.

The bearing capacity of the bed.

In the system of the present invention, the weight of the foldable bed is 8.5 kg of honeycomb paper (The two head boards are not included.).

The volume of the bed when it is folded preferably is 80×40×11 cm.

The time required to fold/unfold the bed is less than 5 minutes.

The bearing capacity of the bed at least 2 tons/m2.

The weight of a foldable bed of 80×200 cm is less than 15 kg depending on the hexagonal cell size and the number of layers. The bearing capacity of the extended structure can carry a weight of more than 1000 kg for a surface of 80×200 cm. The more layers we add in the same area, the more bearing capacity it will carry.

The bed of the current invention is more than 25% lighter than any foldable bed frame. It is dressable where the covers of the two head and back boards can be changed easily and covered by the customer. The volume of the folded bed is half the volume of any foldable bed in the market. The bed is made out of cellulose fiber sheets that are made from recyclable materials. This makes the bed fully green and environmentally friendly. The whole bed can be recycled again in a closed loop.

The weight and the dimensions of the current bed can make it shippable easily by air freight couriers. The shipping of the bed is at an at least 25% lower CO2 footprint than other normal beds in the market.

The flexibility of the honeycomb technology in the bed makes it versatile and multi-functional. The result of the present invention is an apparatus which also can be used as a side table, an ottoman, or a seat.

The fast operation of expanding and folding the bed makes the user experience more efficient and hence more convenient than other foldable beds in the market.

The present invention aims to overcome to the difficulty of transportation and installation plus the convenience in buying, moving in and moving out big pieces of furniture like a bed frame or a sofa.

The structure of the current invention can be used to make a flexible foldable bed frame, and the components of the bed comprising, with reference to FIGS. 1-10:

A—Head Board (1):

Head board (1) can be changeable and dressable as well. The dimensions and materials of the head board (1) can be changed to any size based on the bed size. Meanwhile, the side boards can be dressable where the cover can be replaced by any covering materials like fabric, leather, felt or any soft or rigid materials for aesthetics reason.

B—Flexible Hexagonal Structure (2):

The cell structure is a hexagonal structure that can be uniform or non-uniform. The length between the glue lines and the width of the glue lines affect the shape of the cell. If the the lengths and the widths are equal, the widths will be uniform. Any difference between their dimensions makes the honeycomb non-uniform. The non-uniform structure gives higher extension and makes it easier to open and to fold. The glue line has a width and the spacing between the glue lines has another width. If both widths are the same, the cell will be uniform since all the hexagon sides will be the same. If the widths are not equal, the hexagon sides will not be equal and hence the cell shape will not be uniform.

The length of one side of the hexagonal cell can vary from 1 mm to 150 mm. The width of glue lines can be anything from 1 mm to 50 mm.

C—End Board (3):

The two sides of the honeycomb core are glued to rigid or non-rigid materials. The rigid materials can be any type of wood boards, steel, aluminum or any other rigid materials. The non-rigid boards can be made out of non-woven materials like felt, foam, or any other soft material.

D—Side Boards (4):

The side boards can be rigid or soft boards. The board can be one piece or divided into two or more pieces for foldability reason. The side boards can be changeable to give different shape or color. Meanwhile, the side boards can be dressable where the cover can be replaced by any covering materials like fabric, leather, felt or any soft or rigid materials for aesthetics reason.

The structure of the current invention can also be used to make a flexible foldable sofa, and the components of the sofa are comprising:

A—Flexible Hexagonal Structure (5):

The honeycomb cell structure (1) is hexagonal that can be uniform or non-uniform. The non-uniform structure gives a higher extension and makes it easier to open and fold. The length of one side of one hexagonal cell can vary from 1 mm to 150 mm. The width of a glue line can be anything from 1 mm to 50 mm. The structure takes the shape of the seat and it can be extended from 6 to more than 1000 cm. For typical seating it can range from 20-300 cm.

B—Side board (6): The side boards (6) are connected to the honeycomb structure. The side boards can be rigid or soft boards. They are used to give support to the honeycomb structure and to attach to connectors. These connectors are used to connect the honeycomb structure, when expanded, to extension rods linearly.

C—Extension Rods (7):

The extension rods (7) are responsible for extending the honeycomb structure and fixing them in place. Any number from 1 or more can be used for extending the structure. Typically we use 2 or 4 extension rods. The material of the extension rod can be wood, steel, aluminum, or any rigid material. The rods are connected to the honeycomb structure through the connectors. The length of the rods determines the length of the seat. The rods can vary from 30 to 400 cm depending on the length required of the seat. The extension rods can be elongated to give variable lengths. The rods can be divided into smaller pieces connected together to give flexible lengths. The extension rods are removable, which gives flexibility to the structure to fold back to its original dimension.

D—Armrest (8):

The armrests can be either separate or connected to the seat's honeycomb structure. The armrest can be made out of steel, wood, aluminum, or any rigid structure. The armrest can be of any shape and dimension. The armrest can be padded and/or covered by fabric. The armrest can be also made out foldable honeycomb that can be extended and covered by pieces of hard material like MDF sheets, plywood, or others.

E—Padding (9):

Padding is a sheet of rigid or soft material that can be laid over the honeycomb structure to give fixation, and protection. It is made out of rigid sheet that can be padded by foam and/or fiber. The padding can be covered by fabric or any rigid/soft material.

A goal of the present invention is to provide foldable furniture using honeycomb technology. Moving/shipping furniture like seats and bed frames is a pain due to the furniture's huge volume. Moving a big piece of furniture requires big spaces in shipping containers, big spaces in trucks and laborers to carry them to the final places. Beside the high shipping cost per piece, the CO2 footprint of transporting the big pieces of furniture is high which adds to both the carbon dioxide emissions and ultimately to climate change in terms of global warming. The honeycomb technology is a structure used in manufacturing aero planes bodies and is now used for furniture. The foldability aspect of such technology allows for reducing the volume, the weight, and the cost of the product considerably, which may lead to a complete disruption in the furniture industry.

The present invention relates to a flexible foldable bed made of a core of layers of paper and how it is made. The core shape can be opened and closed manually. The structure is made of honeycomb technology where the layers are glued together with glue. The structure of the hexagonal shape is rigid and can carry heavy weights. The bed is portable and can be carried by one person. The bed is light in weight and is extendable to any length depending on the number of layers. The foldable bed uses extension bars to fix the structure in place using special connections.

The current glue used is a starch with acrylic additives. The glue that can be used includes starch or any other glue like PVA, resins, acrylic or any other glue. The glue can be water based or solvent based. PVA (An aliphatic rubbery synthetic polymer with the formula (C4H6O2)n is preferred due to its elasticity and cost as well. It belongs to the polyvinyl ester family, with the general formula [RCOOCHCH2].

The material used in this structure is preferably paper but can be any flaccid materials like, but not limited to, plastic, non-woven fabric, or synthetic paper. The paper used can be treated to be water resistant and/or fire retardant. The thickness of paper can vary from 10 micron to 15 mm. Other materials can be used to give the hexagonal shapes. Plastic, felt, non-woven fabric can be also used. Any flaccid materials can be used to give the same function.

For paper, paper density can vary from 40 to 500 grams per meter square. Paper also can be engineered to have better edge burst strength of 800 to 900 kPa.

The paper (or other material) used can be treated and sprayed by coloring materials, i.e., with pigments, or dyed in coloring chemicals. Spraying materials can be for any purpose from coloring or adding feature and/or function to the structure like being water proof, or/and fire retardant, changing flexibility, changing color, or changing physical or chemical properties of the paper or other structural material as examples. The honeycomb foldable bed structure of the present invention comprises A—Headboard (1), B—Flexible hexagonal Structure (2), C—End board (3), and D—Side Boards (4).

An advantage of these embodiments is that the structure can be divided into zones with one or more zones having reduced cell size to give more support to the points of stresses of a sleeping person. The cell size can be larger in the areas that will not carry more load.

The structure is also so flexible due to the improvement done herein on the determined cell size and glue size. The cell side is determined by the space between the glue lines in the honeycomb core machine. The width of the glue line is also a factor in giving flexibility to the honeycomb structure. The improvement was done on the machine to increase the length between the glues from 2-3 cm to 7-10 cm. The glue width also was decreased from 10 mm to 2 mm. The glue width can go down to 1 mm. The smaller the glue line and the bigger the width between the glue lines gives higher flexibility.

There are two kinds of foldability for the bed of the current invention as below:

Horizontal foldability: The bed can be folded to be 2 cm and extended to be anything from 2 cm up to 10,000 cm depending on the number of layers glued to each other.

Vertical foldability: The bed itself can be cut into two or more pieces then be attached to each other vertically with a hinge or any other connector. This allows the structure to be folded into two halves or more.

The honeycomb structure bed can be folded down to be 30×30×30 cm. The box which is used for the folded bed can be any size can have any side length from 20 to 300 cm. The box dimensions are variable to accommodate the required size of the mattresses.

The components of the sofa comprise A—Flexible hexagonal Structure (5), B—Side board (6), C—Extension rods (7), D—Armrest (8), and E—Padding (9).

It is worth mentioning that honeycomb structures are natural or man-made structures that have the geometry of a honeycomb to allow the minimization of the amount of used material to reach minimal weight and minimal material cost. The geometry of honeycomb structures can vary widely but the common feature of all such structures is an array of hollow cells formed between thin vertical walls. The cells are often columnar and hexagonal in shape. A honeycomb shaped structure provides a material with minimal density and relative high out-of-plane compression properties and out-of-plane shear properties.

The honeycomb technology in the current invention uses one or more gluing machines to glue the paper (or analogous flexible materials) in parallel glue lines, in which the lines are laid down ready for the next paper sheet. The glue is done in a staggered way for one paper after another. The paper sheets preferably go through two glue stations. The glue lines are applied on paper layer 1 and layer 2 parallel to each other. When applying the glue lines on paper layer 3, they come in the middle of the distance of the glue lines in layer 1 and 2 (location wise). In layer 4, the glue lines are laid in the same location as in layer 1 and 2. And in layer 5, the glue will laid be on the same location as in layer 3, and so forth. If the glue lines are at the same location in all paper layer, the glues paper will not open (no hexagonal cells would be shaped). Hence, the glue lines must alternate between the layers to provide the hexagonal cell shape.

Sheets one and two are glues together by applying parallel glue lines in the first station. Sheets three and four get the same glue lines at the same station. In glue station number two, sheets one and two get new glue lines on their surfaces in the space between the two glue lines that they had in station one so they get glued to sheets three and four. So each single sheet would have parallel glue lines on both surfaces where the glue lines on the surface are not on the same place as the glue lines on the bottom. This staggered way of glue application insures the hexagonal shape of the honeycomb when it gets expanded. The whole stacked paper layer constitutes a block of paper layers. The staggered way of gluing gives us the hexagonal shape constituting the honeycomb structure. Then these layers are cut to the size of the bed by a cutting method. The cut block is attached to the headboard and the end board by glue or any hardware fixture. The hexagonal shape has the property of being expandable manually to the size needed. The length of the expanded honeycomb depends on the number of paper layers. The design of the hexagonal structure, the distance between the glue lines, and the width of the glue lines together makes it easier for the user to expand the bed. Then, the side boards are inserted to keep the structure in place and configured to the designed length ready for the mattress.

The honeycomb material of the present invention is paper or thin-wood based and/or is preferably formed of cellulose fiber. The cellulose is preferable pure white kraft pulp of high brightness and formed of virgin fibers. This brightness is useful for marketing purposes, to observe the presence of defects, and to increase customers' perception of the products' durability and value. The virgin fibers are pure sourced from tree fibers where no recycled paper fibers are used. This insures the strength and the durability of the honeycomb core. In a preferred embodiment of the present invention, the material is sourced from one or more Nordic forests, which is preferred because it comes from renewable forests and for being the highest quality in terms of pulp specifications. In the alternative or in addition, the honeycomb material can be formed of additional materials, such as but not limited to aluminum and plastics and/or other papers.

Figure 11:
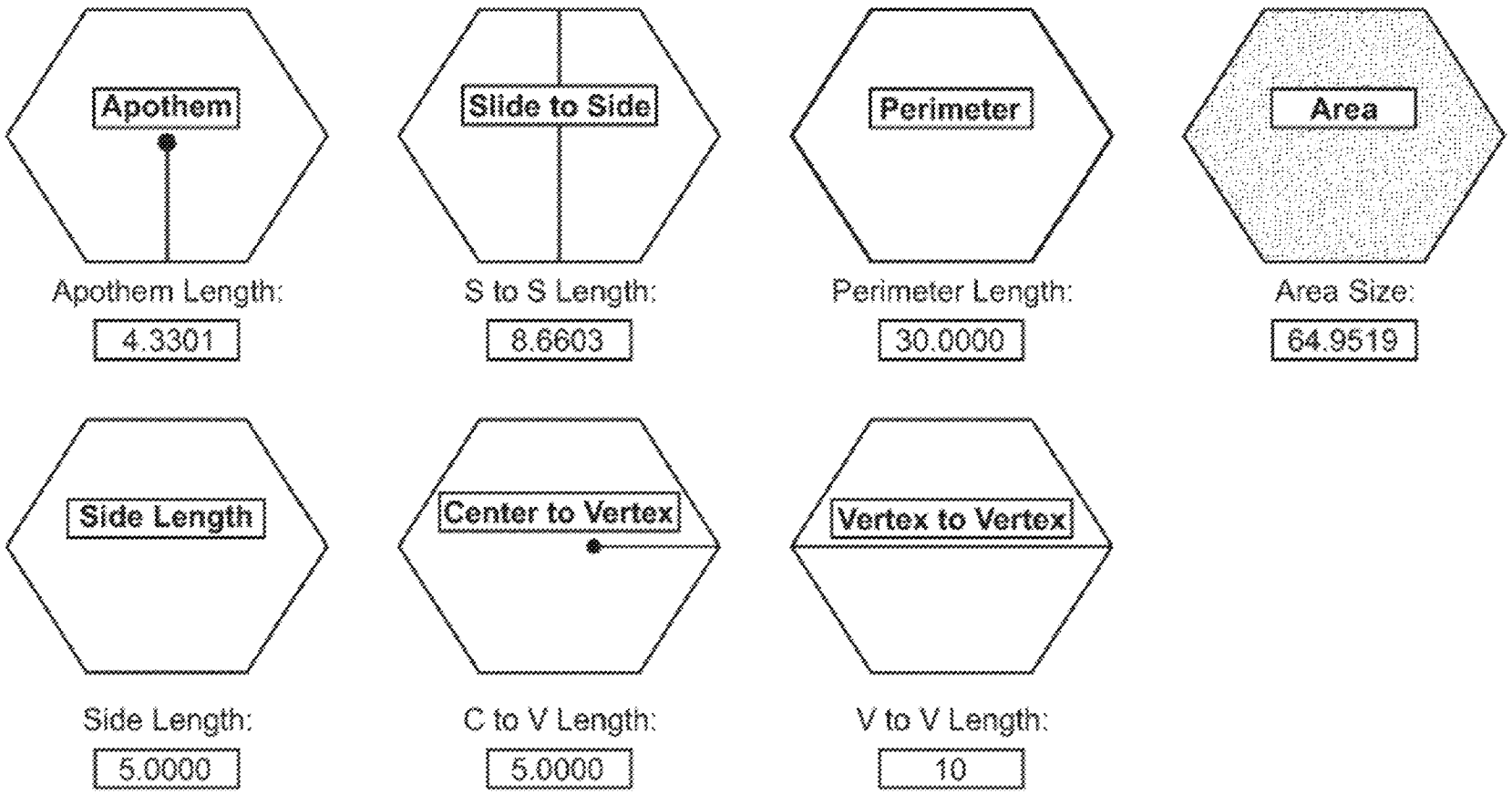
FIG. 11 shows cell size dimensions.

The honeycomb cell size is designed in a way to be folded down and expanded as needed. The cell size of 10 cm vertex to vertex has the dimensions as in FIG. 11.

When paper and/or wood are used, the density is at least 140-170 grams/sq. meter, to assure adequate strength. The paper used should have a weight not less than 140 grams/sq. If less than this weight is used, the honeycomb structure may be affected and hence the durability of the product may be reduced. If less than 140 grams/sq is used in making the honeycomb structure, more layers should be used to compensate for the light weight paper (and hence the structure), which will add unnecessary weight to the product.

Figure 12:
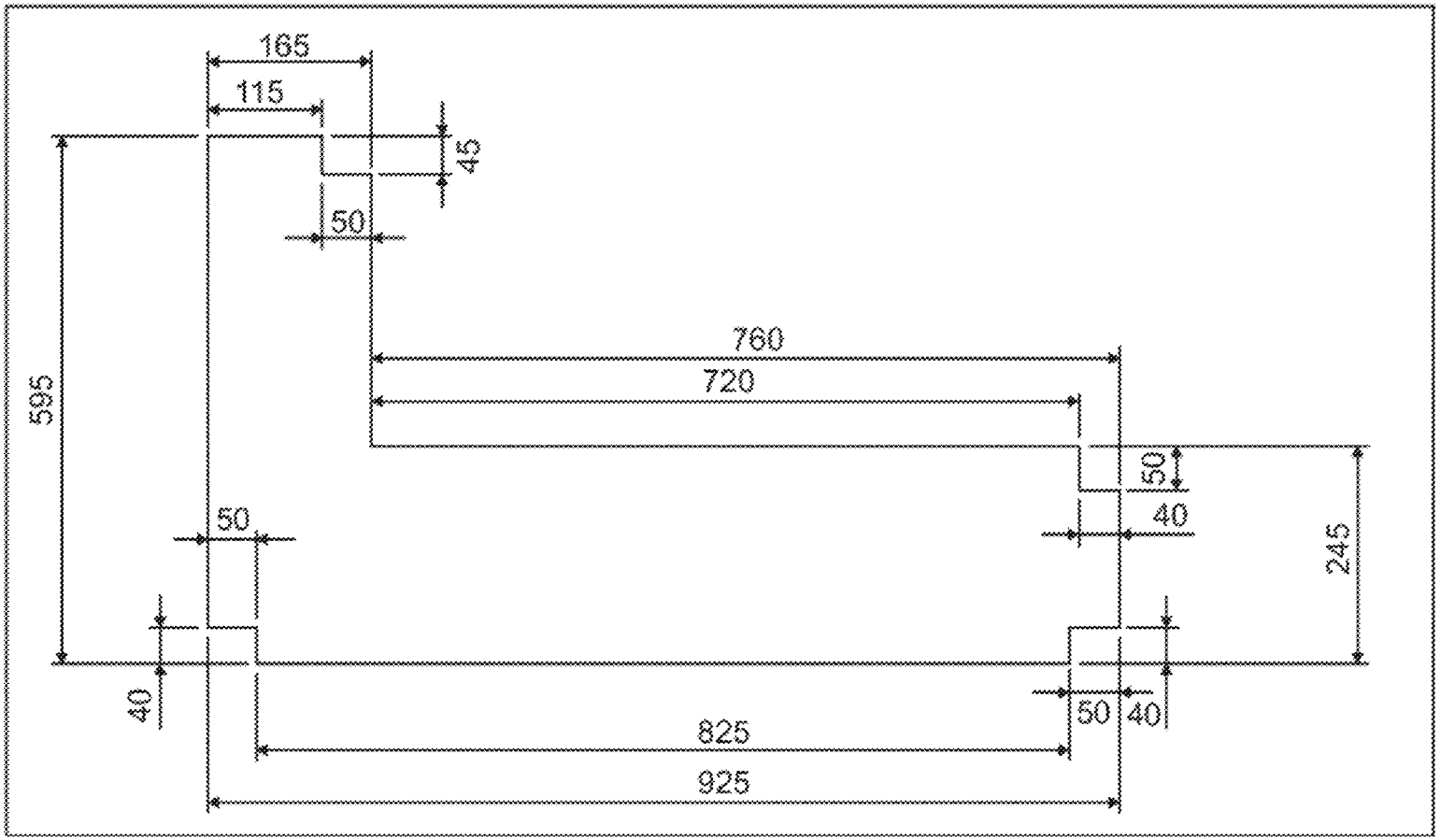
FIG. 12 shows honeycomb dimensions.

For a sofa, the honeycomb structure is cut to the shape of the sofa that has a preferable distance of 174 cm side to side when expanded. The structure is glued to wooden boards that have connectors to the side armrests. The height of the honeycomb preferably is 60 cm and the depth is 92.5 cm as in FIG. 12.

In the preferred embodiment, the material is approved by the German Institute for Risk Management (BfR[1]) and the FDA as a safe material for human contact.

The present configuration is a honeycomb structure with a preferable dimension in expanded form of 10 cm from vertex to vertex, with a range of 5 to 20 cm.

Each unit in the honeycomb when expanded forms a hexagonal prism[2]. Except for edges, each side of each hexagonal prism abuts a side of another hexagonal prism and the sides are attached by glue. That is, each of the six sides are generally attached to a different abutting hexagonal prism along one side using glue. A single glue type is preferably used, with the elastic glue In the preferred embodiment, we use PVA glue of a solid content preferably of 40%+or−2%, Viscosity of 3000+or−1000 cps, specific gravity of 1.1, and pH of 5-6.

Each of the individual honeycombs have a thickness of material ranging from 0.5 to 2 mm.

When used to form a sofa or bed, the honeycomb hexagons form hexagonal-prism-based sheets, whereby the honeycomb hexagons are glued together to form a sheet along a common side, and then the sheet is cut to size. In expanded form, the dimension can be as much as 174 cm long and/or wide. It can be longer or shorter based on the design and desired expansion. Another option is 60 cm×92.5 cm when expanded, such as for a sofa.

The next step in the process is to build a stack (three dimensional construction) by attaching sheets to one another. The cells preferably are aligned one on another, but alternatively may be offset from one another; that is, the hexagon sheets may not align exactly one over another.

In one example, the vertexes of the hexagons in a hexagon sheet may be aligned with the center points of the hexagons in the next sheet and so on.

In general, when expanded, each hexagon has a length, thereby each one forms a regular hexagonal prism when expanded.

In attaching the sheets to one another, the honeycomb sheets are each expanded for attachment. In this case, the same glue preferably is used as was used earlier. We ensure glue only goes to the locations we want by glue rollers with protruding glue rings with equal spaces. These spaces differs from one product to another. Up to 300 sheets can be stacked together. The total thickness when done might differ between different types or styles of furniture (e.g., chair, sofa, or bed).

We use a stacking machine that glues certain type of cellulose fiber sheets layer by layer. The machine provides the glue in parallel lines that provides the shape of hexagonal structure. In a preferred embodiment, the distance between the glue lines is 10 cm. We preferably use 80 layers of these sheets to make the sofa and 100 layers for beds. The stack of these layers is then cut to the shape of the desired furniture piece, such as but not limited to either a sofa, seat, ottoman, bed, or corner unit. The cuts are preferably made manually using a saw machine but could be performed automatically in the alternative. When expanded, the structure gives the look of the honeycomb that can bear vertical load of at least 1 ton/m2.

Cellulose fiber sheets of 140-170 g/m2 are produced from very pure, white kraft pulp of high brightness, and each sheet consists entirely of virgin fibers. The long and strong fibers from the Nordic's slowly growing softwood forests gives the paper its inherent strength.

The cellulose sheets are produced from a mill that preferably is certified in accordance with ISO 9001, ISO 14001, ISO 50001, FSC® CoC (FSC-C020000) and PEFC™ CoC (PEFC/05-33-136).

The honeycomb structure is typically comprised of up to 180 layers of cellulose or hexagon sheets. The sheets are preferably divided into two 90 layer sheet sections. A middle support, typically formed of plywood or another durable light weight material, of a preferable height of 24 cm, may be glued between the two 90 layers of honeycomb sheets. The front panel and back panel are made out of a frame of wood that is laminated with 3 mm MDF board to be covered. Then a layer of 1 cm foam is glued to it. We then add a fabric to cover the foam and staple it to the back side of each panel. We then glue the honeycomb structure to the front panel and back panel preferably using a white or clear glue (such as PVA) and press the panels under a pressing machine for 10-15 minutes.

We prefer to use a white glue Poly Vinyl Acetate (PVA) (commonly known as wood glue or White glue), or equivalent, to glue the sheets together to make the honeycomb structure. An aliphatic rubbery synthetic polymer with the formula (C4H6O2)n, it belongs to the polyvinyl ester family, with the general formula RCOOCHCH2.

If the bed is Queen, King, or Cal King size, each panel may be divided into two parts that each has a hollow inside that has a dimension of the rectangular insert.

A wooden, typically plywood, insert is used to connect the two parts together making the panel.

Figure 13:
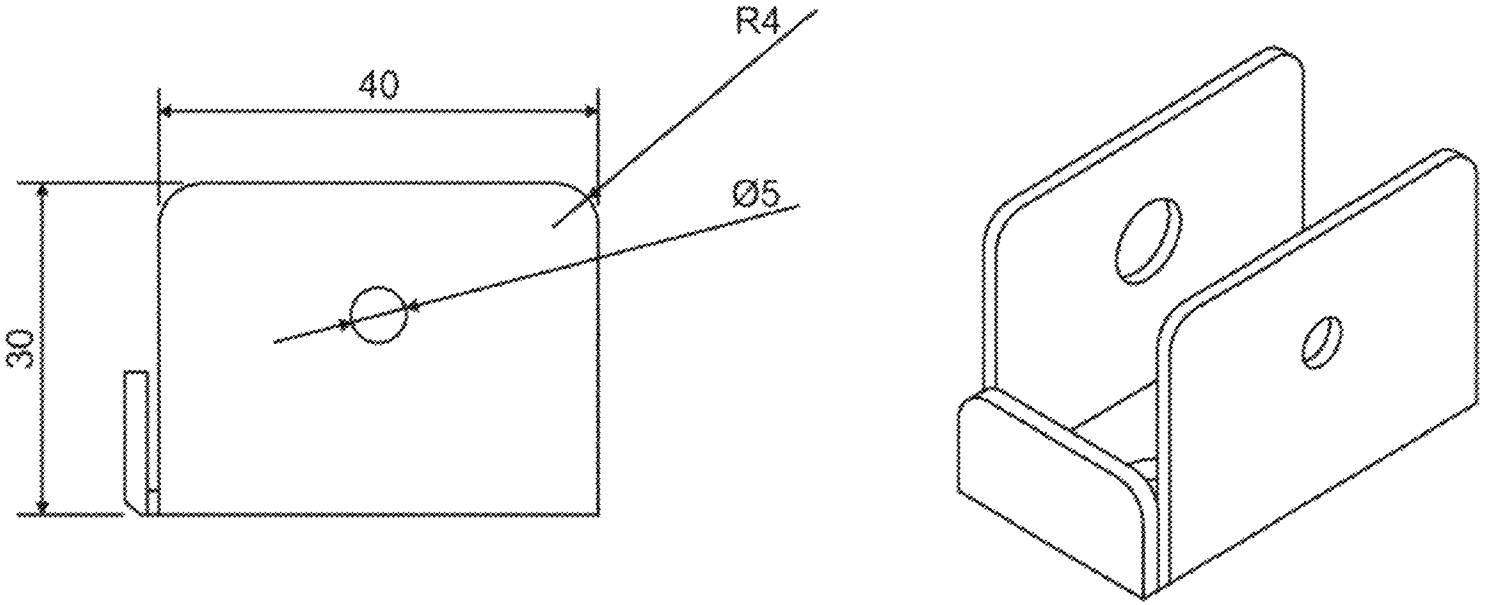
FIG. 13 shows connector dimensions.
Figure 14:
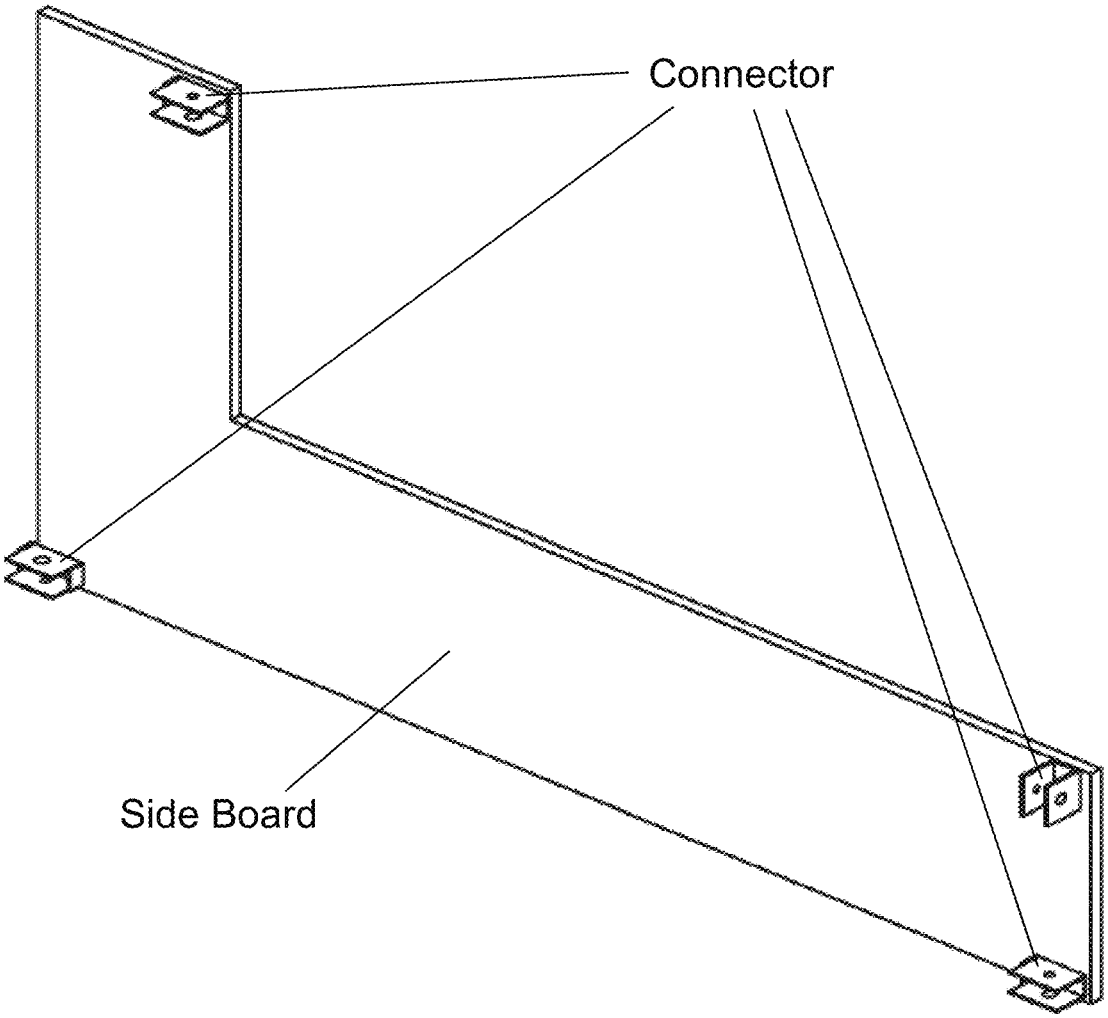
FIG. 14 shows side board dimensions.

The next step in construction is the side boards (such as for a sofa or chair). See FIGS. 13 and 14, with connectors added. Typically the connectors are metal but may be made of other materials, such as wood. The connectors attach the honeycomb to the frame. Eight metal connectors are screwed on the side edges of the front and back panel. The upper four connectors are 2×8×2 cm where the bottom ones are 2×4×2 cm. Each connector is screwed to accept the thumbscrews that are provided separately.

The side boards of the honeycomb are preferably made from wood and covered with fabric. To keep the expanded distance in place, 8 metal connectors are provided to be connected by the expanded wooden beams. The connector preferably is done in a U shape with a bent steel support under it. The connector has two holes: a circular hole of 8 mm and a screw hole of 6 mm that accept a thumb screw of 6 mm as in FIG. 13. The U connectors are fixed by two screws to the wooden side boards as in FIG. 14.

These side boards are formed of wood, usually plywood, medium density fibreboard (MDF), or particle board, and covered with fabric. The invention may include "expanded wooden beams". For a bed, four wooden beams made out of beech wood or equivalent are provided to expand the honeycomb bed and fix it in place to the dimension of 195 cm. Each beam has two halves. The upper two beams have the dimension of 2×8×98 cm. The lower beams have the dimension of 2×4×98 cm. Each half is connected to the second half by a hinge of a 2.5 cm (for the bottom beams and 6 cm for the upper ones).

Wooden beams are used to expand the honeycomb structure of the sofa. Each beam is folded into two halves. The dimension of each half is 2×4×85 cm. The two halves are connected by a hinge of typically 2.5 cm. A metal slide bar of 16 cm is intended to slide over the two expansion beams to support them when expanded. The slide bar is closed from all dimensions except for one dimension that is sliding in the same face of the hinge, where the sliding connector is bent on the wooden beam as per FIG. 15.

Figure 15:
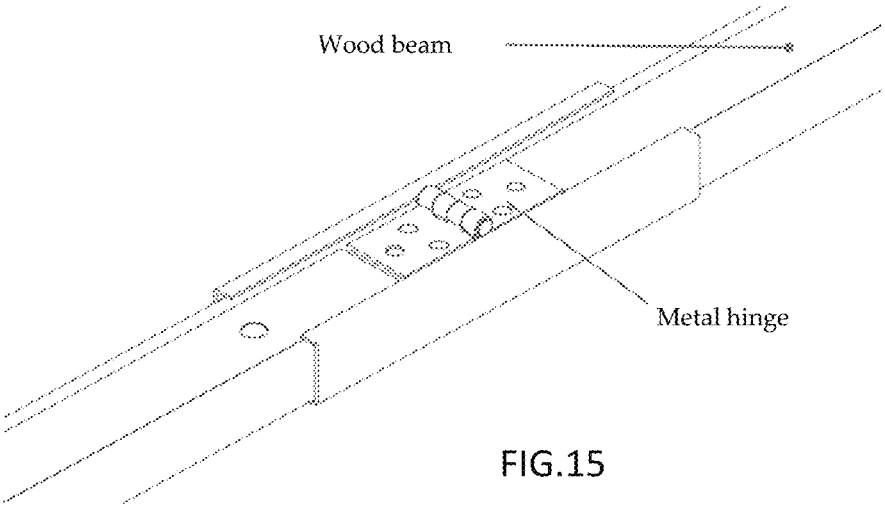
FIGS. 15 and 16 show the physical relationship of a metal hinge and beam.

Expansion beams also are used and preferably are made of wood and include a metal hinge which is encased in a pair of "metal sliding connectors" (per FIG. 15). The expansion beams may be on two sides or four sides of the frame. The purpose of the metal hinge is to allow for folding up the sofa, but the sliding connector locks it in place. Wooden beams are used to expand the honeycomb structure of the sofa. Each beam is folded into two halves. The dimension of each half is 2×4×85 cm. The two halves are connected by a hinge of 2.5 cm. A metal slide bar of 16 cm is intended to slide over the two expansion beams to support them when expanded. The slide bar is closed from all dimensions except for one dimension that is sliding in the same face of the hinge, where the sliding connector is bent on the wooden beam as per FIG. 15.

Figure 16:
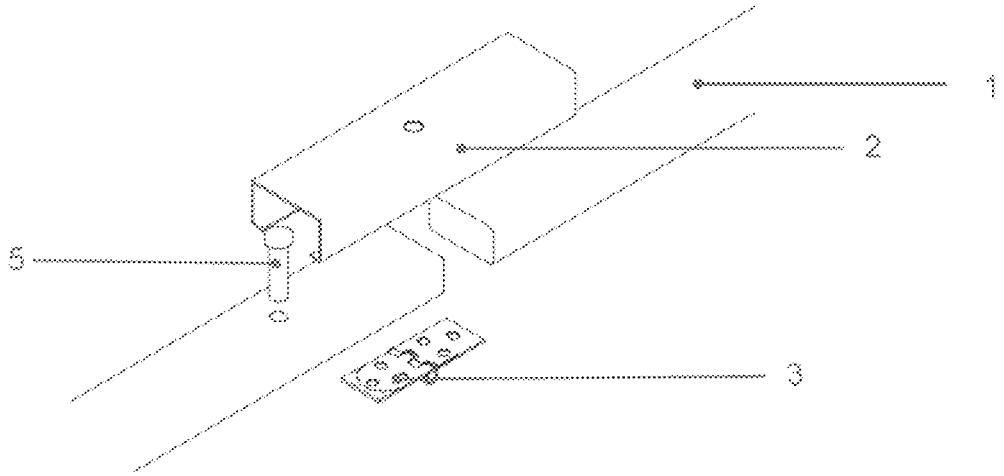

A sliding connector is provided to slide over the beam to be placed exactly in the middle of the beam to give it the support it needs. The sliding connector is stopped from sliding by a metal pin or screw as shown in FIG. 16.

The sofa has 4 wooden beams. All of them are the same except for the two lower beams where a hook-and-loop fastener is provided to be connected to the back padding.

The lower beams have hook-and-loop fastener stapled to the bottom part along the beam. The hook-and-loop fastener is intended to connect the final cover of the bed.

The beams have holes in their edges. The beams are attached to the connectors and then a thumbscrew is screwed inside the hole to connect each beam to each of the front and back panels (total eight screws).

A foldable sleeping pad is laid on the expanded bed. It preferably is shipped in 6 cardboard sheets of 2000 grams/m2 of a dimension of 33.3 cm×76 cm (for queen) or 33.3 cm×90 cm for the king size. The six sheets are connected by a fabric hinge and then all covered by fabric.

The final bed upholstery cover is put to complete the bed. The cover has hook-and-loop fastener underneath that is connected to the hook-and-loop fastener on the lower beams. The upholstery cover has 1 cm foam around to provide a cushioning effect to the 4 sides of the bed.

For back padding two paddings are provided. Each back padding has three plywood boards that is connected by fabric hinge. A layer of foam is provided on one or more boards. The middle part has a foam layer of 4 cm and then all the three parts are covered by one layer of 1 cm foam. The whole back padding is then covered by a fabric cover. The two ends of the padding each have hook-and-loop fastener tape to be connected—one with the lower wooden beam and one with the seat padding hook-and-loop fastener.

For the front padding—two plywood pieces (each has a nominal dimension of 87×26×6 cm) are connected with a fabric hinge. Then the whole structure is covered by a fabric cover that has two hook-and-loop fastener tapes—one on the top and one on the bottom. Both hook-and-loop fastener tapes are intended to be connected—one to the seat padding and the other to the bottom wooden beam.

Figure 17:
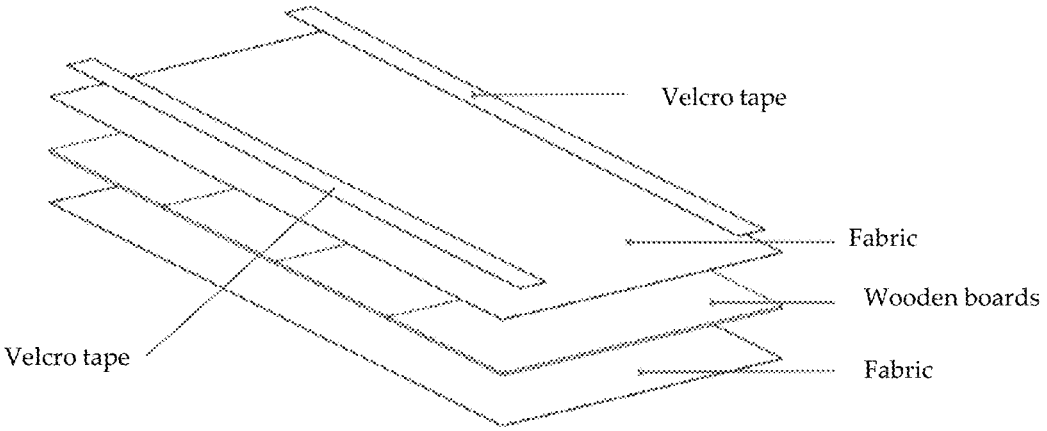
FIG. 17 shows a seat configuration.

The seat padding is foldable, and it has four plywood pieces (each has a nominal dimension of 70×34×6 cm) that are connected with fabric hinge. The upper surface of the seat padding has two hook-and-loop fastener tapes on the upper and the lower ends. These hook-and-loop fastener tapes are intended to be connected with both the back paddings and the front padding. FIG. 17 shows the seat (adding in the hook-and-loop fastener).

Figure 18:
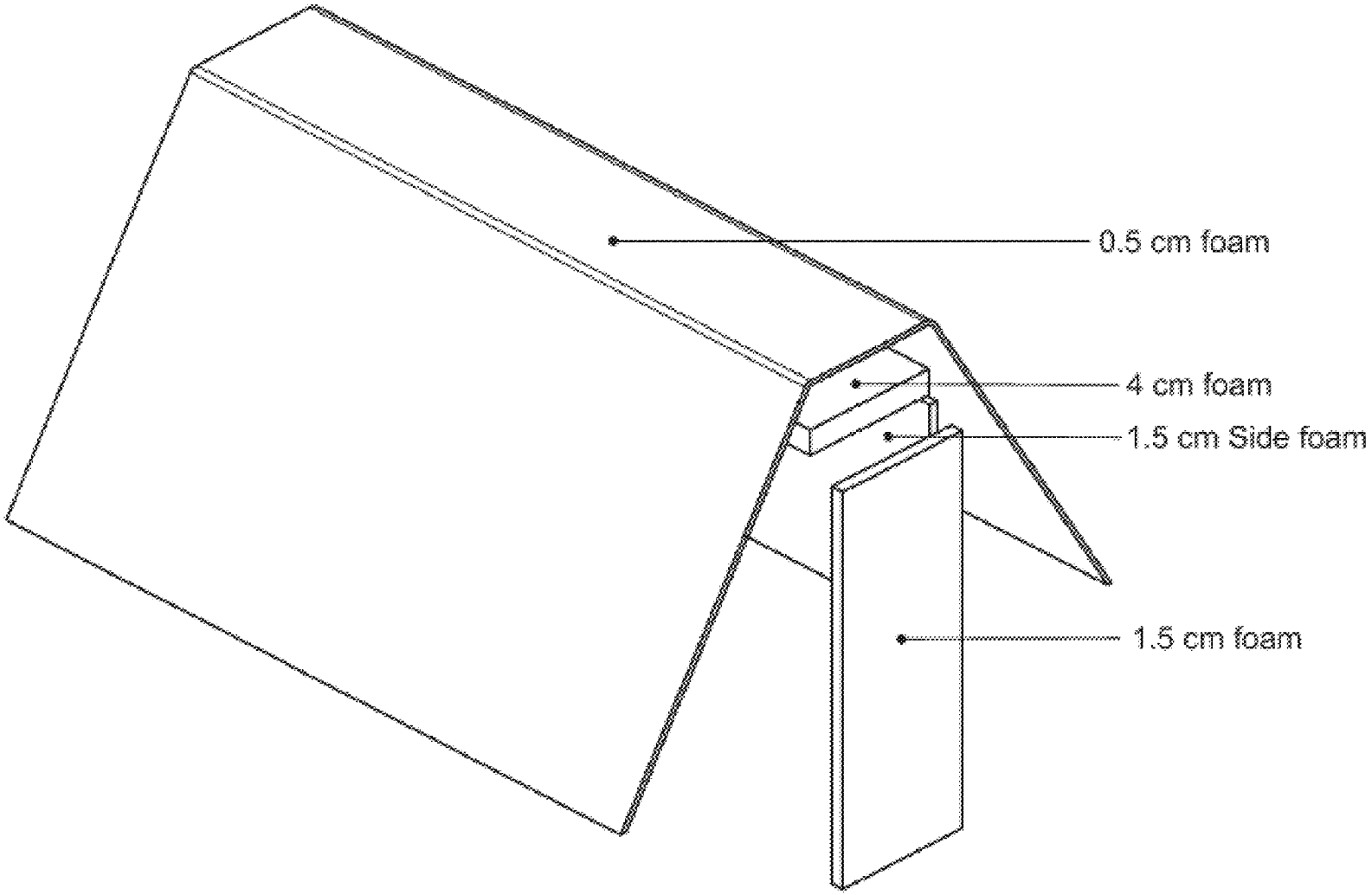
FIG. 18 shows an arm rest configuration.
Figure 19:
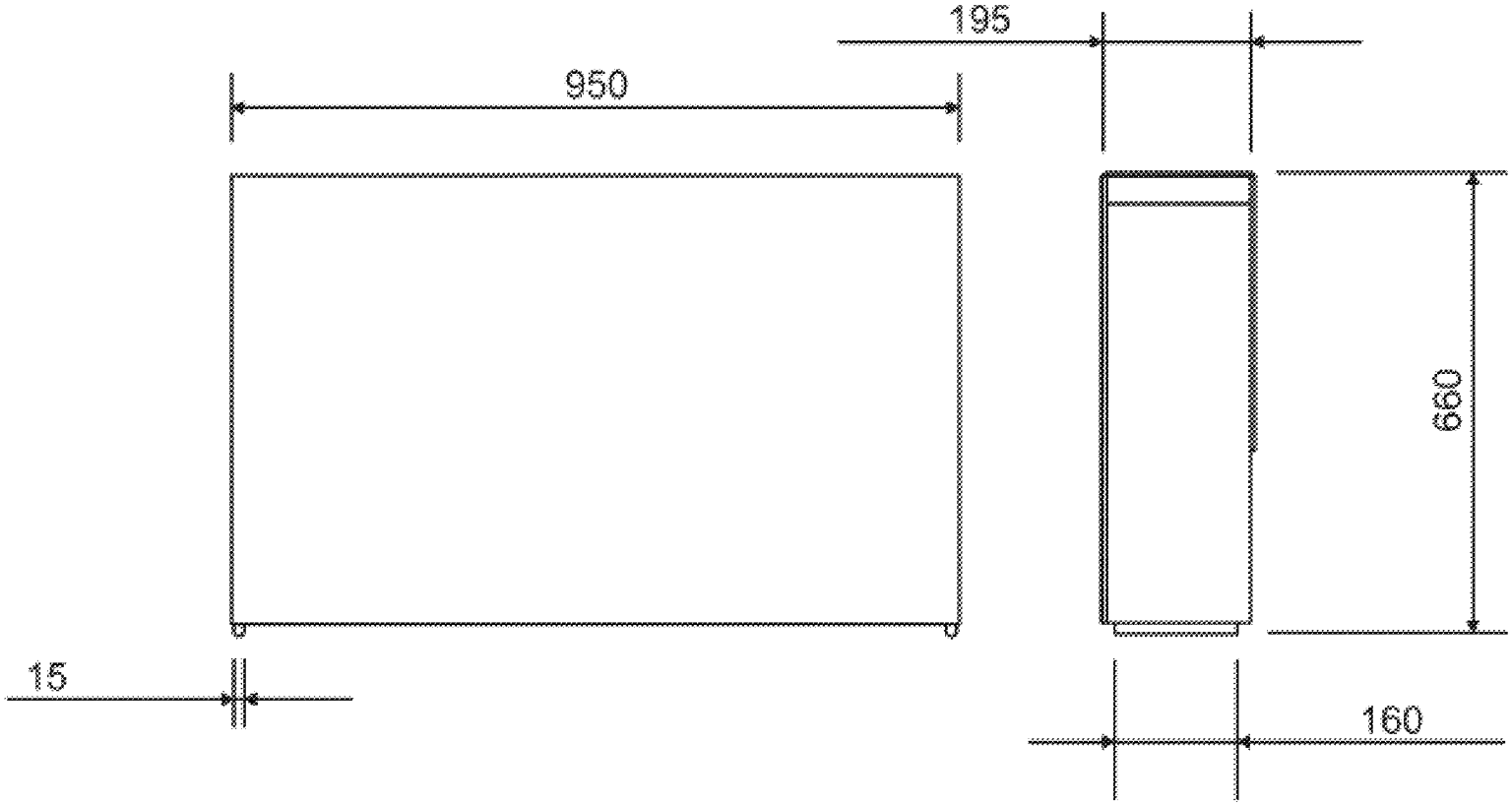
FIG. 19 shows dimensions of an arm rest.
Figure 20:
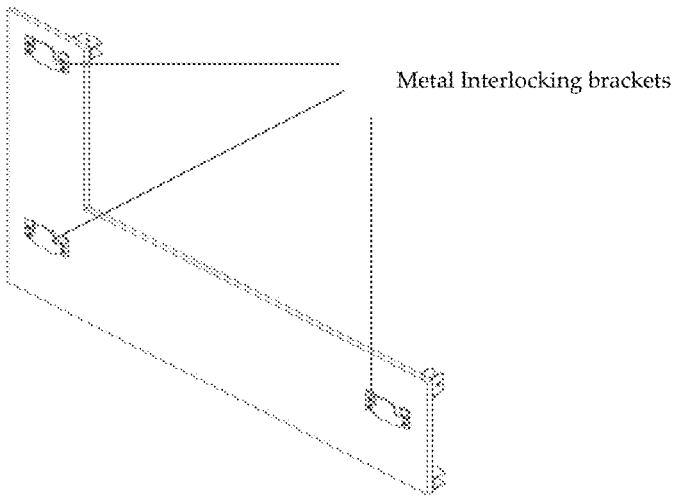
FIGS. 20 and 21 show interlocking brackets connected to the honeycomb.
Figure 21:
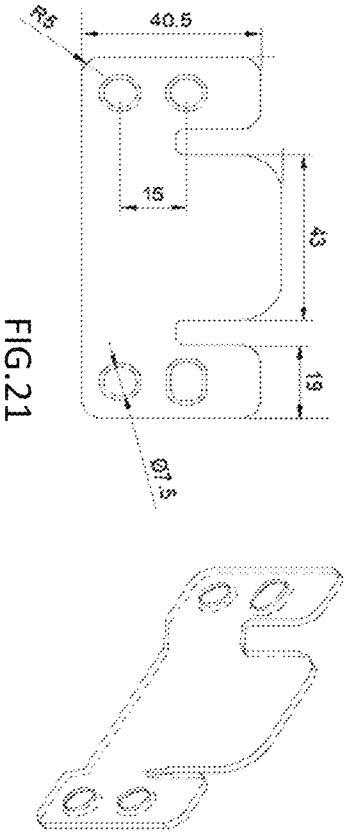

The sofa preferably has two armrests. Each armrest has a nominal dimension of 95×19.5×66 cm. The armrests are preferably hollow and covered with fabric from inside. The hollow armrests are intended to act as compartments for the sofa components (padding, cushions, pillows and expansion beams. The armrest structure is made out of wood that is covered from the top by foam of 4 cm and with a layer of 0.5 cm foam covering the whole armrest. Each armrest has a metal connector to be connected to the honeycomb sides as in FIG. 18. FIG. 18 shows the interlocking for the armrest. Arm rest dimensions are shown in FIG. 19. Each armrest has three metal interlocking brackets to be connected to the honeycomb wooden sides as in FIG. 20. The detail of the metal interlocking bracket is shown in FIG. 21.

Figure 22:
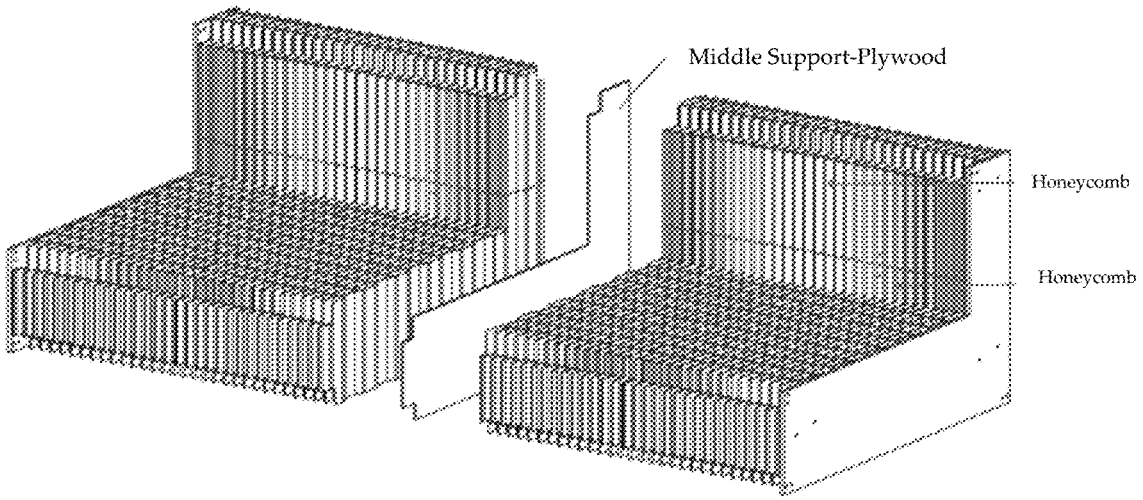
FIG. 22 shows the present invention's honeycomb arrangement in a seat.

The honeycomb structure is supported by a plywood support that is glued in the middle layers of the honeycomb. The support acts as a carrier for the upper wooden beams. The preferred shape of the wooden support is shown in FIG. 22.

The invention claimed is:

1. A method for forming a furniture foundation comprising the steps of:

forming a plurality of three dimensional expandable shapes formed of flexible material, each shaped as a regular hexagonal prism when expanded and each with a length, open at the top and bottom, each said regular hexagonal prism of generally the same dimensions as all others in said plurality;

adjoining a plurality of said regular hexagonal prisms to one another to form a honeycomb sheet by abutting each of said regular hexagonal prism along a common side with at least one other of said regular hexagonal prisms by applying at least one glue line along a length for said adjoining;

forming at least four of said honeycomb sheets;

cutting each said honeycomb sheet to a desired dimension;

expanding at least four of said plurality of honeycomb sheets and laying a first said honeycomb sheet over a second said honeycomb sheet;

gluing said first and second said honeycomb sheets together by administering glue at at least some points of intersection thereby forming a first section;

laying a third said honeycomb sheet over a fourth said honeycomb sheet; and gluing said third and fourth said honeycomb sheets together by administering glue at at least some points of intersection thereby forming a second section; and attaching said first and said second sections to a common connecting element, thereby forming a furniture foundation;

where the furniture foundation is configured to fold on itself for transport.

2. The method of claim 1 further comprising the step of attaching side boards covered in fabric by screwing said side boards to said foundation using U shaped connectors.

3. The method of claim 1 where each glue line distance is 1 to 50 mm long.

4. The method of claim 3, where parallel glue lines are separated by at least 3 cm.

5. The method of claim 1 where the glue is formed of at least one of starch and acrylic materials.

6. The method of claim 1 where the flexible material is paper.

7. The method of claim 6 where said paper is sourced from Nordic forests.

8. The method of claim 1 further including hollow arm rests attached to said side boards.

9. The method of claim 1 said arm rests are usable to store materials.

10. The method of claim 1 wherein said foundation further including expansion beams with embedded metal connectors.

11. A method for forming a foldable bed foundation comprising the steps of:

forming a plurality of three dimensional expandable shapes formed of flexible material, each shaped as a regular hexagonal prism when expanded and each with a length, open at the top and bottom, each said regular hexagonal prism of generally the same dimensions as all others in said plurality;

adjoining a plurality of said regular hexagonal prisms to one another to form a honeycomb sheet by abutting each of said regular hexagonal prism along a common side with at least one other of said regular hexagonal prisms by applying at least one glue line along a length for said adjoining;

forming at least four of said honeycomb sheets;

cutting each said honeycomb sheet to a desired dimension;

expanding at least four of said plurality of honeycomb sheets and laying a first said honeycomb sheet over a second said honeycomb sheet;

gluing said first and second said honeycomb sheets together by administering glue at at least some points of intersection thereby forming a first section;

laying a third said honeycomb sheet over a fourth said honeycomb sheet; and gluing said third and fourth said honeycomb sheets together by administering glue at at least some points of intersection thereby forming a second section; and attaching said first and said second sections to a common connecting element thereby forming a bed foundation with a first end and an opposing second end; and using at least one fabric hinge, adding a sleeping pad foldable in six sections, said pad connected using at least one fabric hinge;

where the bed is configured to fold on itself for transport.

12. The method of claim 11, further including the step of gluing a headboard element to a first end of said bed foundation.

13. The method of claim 12, further including the step of gluing an end board element to a second end of said bed foundation.

14. The method of claim 13 further including the steps of disposing a first side board on the first side of said bed foundation, the first side board extending between the headboard and the end board; disposing a second side board on the second side said bed foundation, the second side board extending between the headboard and the end board; and covering each of the first and second side boards with least one of the items from the group consisting of fabric, leather, and felt.

15. The method of claim 11, wherein the flexible material is fire retardant and waterproof.

16. A method for formulating a foldable furniture foundation for furniture with a seat comprising the steps of:

forming a plurality of three dimensional expandable shapes formed of flexible material, each shaped as a six-sided regular hexagonal prism when expanded and each with a length, open at the top and bottom, each said regular hexagonal prism of generally the same dimensions as all others in said plurality;

adjoining a plurality of said regular hexagonal prisms to one another to form a honeycomb sheet by abutting each of said regular hexagonal prism along a common side with at least one other of said regular hexagonal prisms by applying at least one glue line along a length for said adjoining;

forming at least four of said honeycomb sheets;

cutting each said honeycomb sheet to a desired dimension;

expanding at least four of said plurality of honeycomb sheets and laying a first said honeycomb sheet over a second said honeycomb sheet;

gluing said first and second said honeycomb sheets together by administering glue at at least some points of intersection thereby forming a first section;

laying a third said honeycomb sheet over a fourth said honeycomb sheet; and gluing said third and fourth said honeycomb sheets together by administering glue at at least some points of intersection thereby forming a second section;

attaching said first and said second sections to a common connecting element, thereby forming a seating foundation;

attaching at least one extension rod and at least two side boards, attaching a first and a second armrest at each at one of said side board, adding padding disposed over said structure; and sponge material disposed over said padding;

where the foldable chair or sofa is configured to fold on itself for transport.

17. The method of claim 16 further including the steps of: disposing a first side board on the first side of the seating foundation, the first side board extending between the headboard and the end board; disposing a second side board on the second side of the seating foundation, and covering each of the first and second side boards with least one of the items from the group consisting of fabric, leather, and felt.

18. The method of claim 16 further including hollow arm rests attached to said side boards and containing space for storage usable in transport.

19. The method of claim 16 where the flexible material has a weight of about 40 to 500 grams per square meter.

20. The method of claim 16 further comprises a back portion formed of at least one honeycomb sheet.

* * * * *